US006561640B1

(12) United States Patent
Young

(10) Patent No.: US 6,561,640 B1
(45) Date of Patent: May 13, 2003

(54) SYSTEMS AND METHODS OF PRINTING WITH ULTRAVIOLET PHOTOSENSITIVE RESIN-CONTAINING MATERIALS USING LIGHT EMITTING DEVICES

(75) Inventor: Michael Y. Young, Cupertino, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,906

(22) Filed: Oct. 31, 2001

(51) Int. Cl.[7] ..... B41J 2/01; B41J 2/325; B41J 2/435

(52) U.S. Cl. ..... 347/102; 347/213; 347/224

(58) Field of Search ..... 347/100, 101, 347/102, 103, 96, 171, 213, 224; 399/266

(56) References Cited

U.S. PATENT DOCUMENTS

| | | | | |
|---|---|---|---|---|
| 4,276,405 | A | 6/1981 | Koleske et al. | 528/58 |
| 4,732,858 | A | 3/1988 | Brewer et al. | 437/228 |
| 4,818,780 | A | 4/1989 | Murray et al. | 524/430 |
| 4,822,718 | A | 4/1989 | Latham et al. | 430/271 |
| 4,876,165 | A | 10/1989 | Brewer et al. | 430/7 |
| 4,910,122 | A | 3/1990 | Arnold et al. | 430/313 |
| 4,950,583 | A | 8/1990 | Brewer et al. | 430/311 |
| 4,978,969 | A | 12/1990 | Chieng | 346/1.1 |
| 5,024,922 | A | 6/1991 | Moss et al. | 430/330 |
| 5,041,846 | A | 8/1991 | Vincent et al. | 346/25 |
| 5,057,399 | A | 10/1991 | Flaim et al. | 430/313 |
| 5,110,697 | A | 5/1992 | Lamb, III et al. | 430/14 |
| 5,138,424 | A | 8/1992 | Moss et al. | 357/52 |
| 5,234,990 | A | 8/1993 | Flaim et al. | 524/609 |
| 5,262,195 | A | 11/1993 | Moss et al. | 427/101 |
| 5,281,690 | A | 1/1994 | Flaim et al. | 528/353 |
| 5,329,295 | A | 7/1994 | Medin et al. | 346/25 |
| 5,336,925 | A | 8/1994 | Moss et al. | 257/643 |
| 5,340,619 | A | 8/1994 | Chen et al. | 424/498 |
| 5,362,608 | A | 11/1994 | Flaim et al. | 430/327 |
| 5,368,989 | A | 11/1994 | Flaim et al. | 430/271 |
| 5,401,613 | A | 3/1995 | Brewer et al. | 430/323 |
| 5,406,321 | A | 4/1995 | Schwiebert et al. | 347/102 |
| 5,428,384 | A | 6/1995 | Richtsmeier et al. | 347/102 |
| 5,467,119 | A | 11/1995 | Richtsmeier et al. | 347/102 |
| 5,479,199 | A | 12/1995 | Moore et al. | 347/102 |
| 5,505,093 | A | 4/1996 | Giedd et al. | 73/774 |
| 5,578,676 | A | 11/1996 | Flaim et al. | 524/609 |
| 5,629,665 | A | 5/1997 | Kaufmann et al. | 338/18 |
| 5,633,465 | A | 5/1997 | Kaufmann et al. | 73/755 |
| 5,633,668 | A | 5/1997 | Schwiebert et al. | 347/102 |
| 5,674,648 | A | 10/1997 | Brewer et al. | 430/18 |
| 5,688,987 | A | 11/1997 | Meador et al. | 558/393 |
| 5,693,691 | A | 12/1997 | Flaim et al. | 523/436 |
| 5,753,523 | A | 5/1998 | Giedd et al. | 437/18 |
| 5,780,201 | A | 7/1998 | Sabnis et al. | 430/270.1 |
| 5,784,090 | A | 7/1998 | Selensky et al. | 347/102 |
| 5,889,084 | A * | 3/1999 | Roth | 523/161 |
| 5,892,096 | A | 4/1999 | Meador et al. | 558/393 |
| 5,952,401 | A | 9/1999 | Kimura et al. | 523/161 |
| 5,985,984 | A | 11/1999 | Chatterjee et al. | 524/589 |
| 6,013,749 | A | 1/2000 | Baba et al. | 526/279 |
| 6,248,804 | B1 * | 6/2001 | Lutz | 523/160 |
| 6,354,700 | B1 * | 3/2002 | Roth | 347/103 |

* cited by examiner

*Primary Examiner*—John Barlow
*Assistant Examiner*—An H. Do
(74) *Attorney, Agent, or Firm*—Oliff & Berridge, PLC

(57) ABSTRACT

Method of printing with ultraviolet photosensitive resin-containing materials includes depositing at least one substance that includes an ultraviolet photosensitive resin on to a substrate, partially curing the substance by irradiating the substance with at least one ultraviolet light emitting device, and completely curing the substance. Substance curing system including a substrate, an applicator that deposits a substance that includes an ultraviolet photosensitive resin on to a substrate, and at least one ultraviolet light emitting device usable to irradiate the substance to partially cure and/or completely cure the substance.

22 Claims, 7 Drawing Sheets

SYSTEMS AND METHODS OF PRINTING WITH ULTRAVIOLET PHOTOSENSITIVE RESIN-CONTAINING MATERIALS USING LIGHT EMITTING DEVICES

BACKGROUND OF THE INVENTION

1. Field of Invention

This invention is directed to systems and methods for printing with substances including ultraviolet photosensitive resins.

2. Description of Related Art

Direct marking print technologies are often limited by the time necessary to dry or cure the particular material that is being printed. For example, the ink drying inadequacies associated with ink jet-type printing have resulted in a limited number of applications for printing by this method. Printing by this method is seen most frequently in slow desktop printers. Once a water-based substance used in printing is applied to a substrate, such as paper, the ink remains wet until air dried or heat dried. In applications where double-side printing is required, or where printing is performed on non-absorbent substrates, the slow dry time and paper cockling are obstacles to high print speeds. Slow dry time also limits speed and quality when printing with several different substances. For example, when different colored inks are deposited adjacent to each other, lateral, or intercolor bleed of the wet ink can reduce precision in graphics printing and other color printing applications.

A new printing technology exists that increases printing speed with fast, controllable drying ultraviolet photosensitive resin-containing substances. The ultraviolet photosensitive resins in each substance cross-link when irradiated with ultraviolet light, thus reducing the need to evaporate solvents, such as water, from the substance to achieve a solid state. Fast drying substances containing ultraviolet photosensitive resins work well with direct marking print technology near room temperature.

The lithography industry is rapidly switching over to ultraviolet curable inks and pastes to take advantage of the fast drying nature of ultraviolet photosensitive inks on various substrates. However, the ultraviolet photosensitive substances used in lithography presses tend to have high tack or viscosity. Such formulations will not work with conventional ink jet technology. To use ultraviolet photosensitive inks in inkjet printing, an ink formulation having a low viscosity is required. Such formulations are known to those skilled in the art and can be manufactured using ultraviolet photosensitive resins typically used in the liquid crystal display industry.

With direct marking print technologies, such as ink jet applications, drop diameter spread control directly impacts the quality of print image resolution. To minimize lateral ink spread, the drop volume needs to be controlled and minimized, generally by using various ink delivery technologies. Properly selecting the target media substrate is also important. For example, cut-sheet paper tends to absorb water-based ink vertically and laterally, i.e., into and along the surface of the sheet. Furthermore, for printing on non-absorbing and semi-absorbing substrates, like transparencies, slow drying liquids, such as water based inks, will stay fluid and be held by surface tension until dried. These undried liquid puddles tend to smear if touched before they are completely dried.

SUMMARY OF THE INVENTION

In direct marking ejection or deposition methods, such as inkjet printing, the properties of the substances being ejected or deposited are beneficially different at different stages of the process. For example, in the ejection head of a fluid ejection system, low viscosity is desirable, so that the fluid, such as ink, can be readily deposited on a substrate. For a brief time after an ejected fluid droplet hits the substrate, a medium viscosity is desirable to allow intimate bonding of the fluid to the substrate, such as ink to the fibers of a sheet of paper, in a controlled fashion. However, quickly thereafter it is desirable that the fluid becomes rigid, to avoid lateral bleed and further vertical penetration, which can cause paper cockling. Curing substances containing ultraviolet photosensitive resins with conventional ultraviolet illumination, such as with a lamp or electron beam, makes it difficult to obtain the two separate viscosity phases of the substance that follow deposit on a substrate as described above.

Uncontrolled lateral spread of ejected fluids used in fluid ejection systems can be reduced and controlled by using fluids containing ultraviolet photosensitive resins. The quick-drying nature of such fluids eliminates the problems of uncontrolled lateral spread and slow drying of ejected fluids. Due to the fast-drying nature of fluids containing these resins, such as ultraviolet photosensitive resin ink, this fluid ejecting method is extendible to ejecting fluids onto any substrate. Ultraviolet light intensity and exposure time duration can provide control over lateral spread, by permitting the partial curing of a fluid containing an ultraviolet photosensitive resin.

Curing fluids or other substances, such as inks, containing ultraviolet photosensitive resins, is often accomplished using an electron beam or an ultraviolet lamp. Such methods of curing an ultraviolet photosensitive resin are deficient, because, for example, the ultraviolet lamp emits broad ranges of frequencies and wavelengths of ultraviolet light, and can not be used to selectively cure multiple ultraviolet photosensitive resins, that react to certain specific target wavelengths of ultraviolet light. Such methods also waste energy, by emitting light at wavelengths that are not absorbed by the employed resins. Such methods are also limited in their applications, due to considerations of portability, power consumption, and ability to achieve a small form factor.

Thus, there is a need for an improved method of curing substances containing ultraviolet photosensitive resins.

This invention provides systems and methods for curing substances containing ultraviolet photosensitive resins using ultraviolet light emitting devices.

This invention provides systems and methods for curing substances containing ultraviolet photosensitive resins that provide enhanced portability, power consumption, and the ability to achieve a smaller form factor.

This invention provides systems and methods for curing substances containing ultraviolet photosensitive resins that permit irradiation with narrow ranges of wavelengths of ultraviolet light, and selective irradiation of multiple substances that are sensitive to distinct wavelengths of ultraviolet light.

Various exemplary embodiments of the methods according to this invention include depositing or ejecting at least one substance that includes an ultraviolet photosensitive resin on to a substrate, partially curing the substance by irradiating the substance with at least one ultraviolet light emitting device, and subsequently completely curing the substance.

Various exemplary embodiments of the systems according to this invention include an applicator usable to eject or deposit at least one substance that includes an ultraviolet photosensitive resin onto a substrate, and at least one ultraviolet light emitting device or at least one array of ultraviolet light emitting devices, positioned relative to the applicator, and capable of irradiating the at least one substance that has been ejected or deposited onto the substrate.

Various other exemplary embodiments of the systems according to this invention include an intermediate substrate, an applicator usable to eject or deposit at least one substance that include an ultraviolet photosensitive resin onto the intermediate substrate, a first ultraviolet light emitting device positioned relative to the intermediate substrate usable to partially cure the at least one substance on the intermediate substrate. The intermediate substrate is positioned to be usable to transfer the at least one substance from the intermediate substrate to a second substrate.

These and other features and advantages of this invention are described in, or are apparent from, the following detailed description of various exemplary embodiments of the systems and methods according to this invention.

BRIEF DESCRIPTION OF THE FIGURES

Various exemplary embodiments of this invention will be described in detail, with reference to the following figures, wherein.

DETAILED DESCRIPTION OF EXEMPLARY EMBODIMENTS

Figure 1:
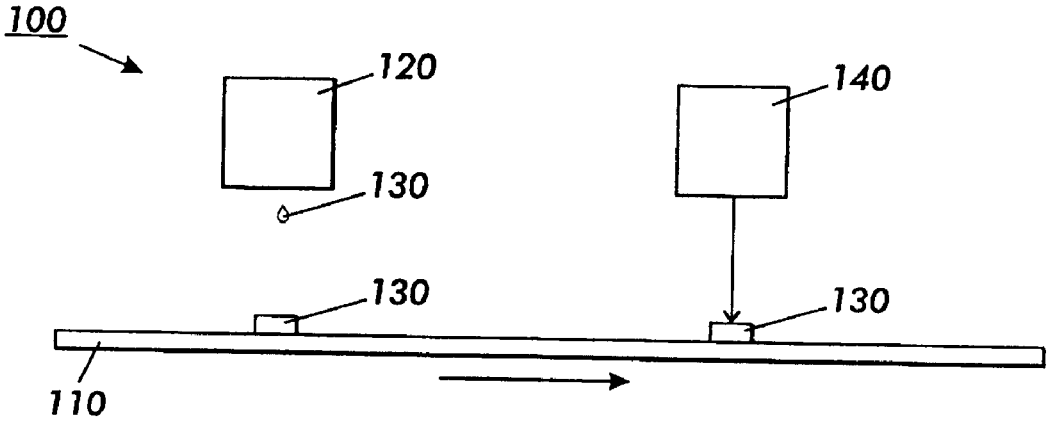
FIG. 1 is a schematic depiction of a first exemplary embodiment of the system according to the invention.

This invention is directed to systems and methods for curing substances that include ultraviolet photosensitive resins. The substances include inks and other fluids that include ultraviolet photosensitive resins. The methods for curing include multiple exposures to ultraviolet light. This invention is further directed to systems that are usable to cure substances that include ultraviolet photosensitive resins.

In various exemplary embodiments, the methods according to this invention include depositing or ejecting at least one substance that includes an ultraviolet photosensitive resin onto a substrate, partially curing the substance by irradiating the substance using at least one ultraviolet light emitting device, and separately completing the curing of the substance.

The at least one substance includes an ultraviolet photosensitive resin that polymerizes upon exposure to ultraviolet wavelengths of light. Alternatively, the ultraviolet photosensitive resin can polymerize upon exposure to a targeted frequency or wavelength range of ultraviolet light while being beneficially insensitive to other ranges of ultraviolet light, especially the targeted ranges associated with other substances employed in the particular system. Partially curing the substance includes irradiating the substance with an amount of ultraviolet light having a wavelength within the range of wavelengths to which the constituent ultraviolet photosensitive resin reacts, where the amount of light is effective to achieve a first viscosity in the substance. Completing the curing of the substance can include irradiating the substance with a further amount of ultraviolet light having a wavelength within the range of wavelengths to which the constituent photosensitive resin reacts, where the further amount of ultraviolet light is effective to achieve a second viscosity in the first substance, and where the second viscosity is greater than the first viscosity.

In various exemplary embodiments, the substance can be ink and the substrate can be paper. In such embodiments, the first viscosity can be a viscosity effective to permit the ink to permeate the paper. The second viscosity can be a viscosity effective to substantially prevent lateral bleeding of the ink.

In various exemplary embodiments, the substance is partially cured with at least one ultraviolet light emitting device. The substance can be partially cured using a filtered ultraviolet lamp, an ultraviolet laser or an ultraviolet light emitting diode. The at least one ultraviolet light emitting device can include a stationary flood laser, a scanning laser beam, a single light-emitting diode or an array of light-emitting devices. The at least one ultraviolet light emitting device can controllably emit ultraviolet light at various intensities and for various lengths of time. The at least one ultraviolet light emitting device can be capable of separately emitting different wavelengths of light.

In various exemplary embodiments, completing the curing of the substance also includes irradiating the substance using an ultraviolet light emitting device. The ultraviolet light emitting device can include ultraviolet light emitting diodes and ultraviolet lasers. An exemplary light emitting diode is an $Al_xGa_{1-x}N$ light emitting diode, where x is the relative concentration of Al in the alloy and 1−x is the relative concentration of Ga in the alloy. In such a light emitting diode, each value of x corresponds to a different narrow band of wavelengths to be emitted.

In various exemplary embodiments, completing the curing of the substance includes irradiating the substance using stationary flood lasers, scanning laser beams, a single light-emitting diode or an array of light-emitting diodes. The light emitting devices employed to finish curing the substance according to the systems and methods of this invention can be capable of separately emitting different wavelengths of light.

Employing this laser beam/light emitting diode curing technique makes it possible to achieve small form factor, lower power consumption and, potentially, equipment portability. In particular, the technique can be suitable for curing ultraviolet resin ink on paper or on an intermediate transfuse or transfer belt or roller. Properly selecting the one or more operating wavelengths of the one or more light emitting devices will control the effectiveness of the exposure in curing the substance according to the substance's photo response. Using a scanning laser curing system increases the delivery of high beam intensity for localized spot exposure while providing a wide area of coverage. Various exemplary scanning laser curing systems include a polygon raster output scanner with a rotating mirror to achieve high scan efficiency.

In various exemplary embodiments, the systems and methods of this invention further include transferring the substance from the first substrate to a second substrate after partially curing the substance and prior to completing the curing of the substance. In such embodiments, the systems and methods include depositing at least one substance that includes an ultraviolet photosensitive resin onto a first substrate, partially curing the substance by irradiating the substance using at least one ultraviolet light emitting device, transferring the substance to a second substrate, and then completing the curing of the substance.

In various exemplary embodiments of the systems and methods, the first substrate is an intermediate transfuse or transfer belt or roller and the second substrate is a sheet of paper. Using an intermediate transfuse belt with ultraviolet resin ink helps in controlling subsequent ink penetration into the paper substrate. This is accomplished by partially curing the substance on the intermediate transfuse belt by exposing the substance to ultraviolet light. Additionally, more uniform image pile height can also be achieved as the print image on the intermediate transfuse belt is transferred to the paper substrate.

The first substrate can also be a blackened intermediate transfuse belt. A blackened intermediate transfuse belt addresses the problem of ultraviolet light reflection on the first substrate. In various exemplary embodiments, the belt surface is blackened to reduce stray light exposure pixel crosstalk effects.

In various exemplary embodiments of the methods according to this invention, depositing at least one substance includes depositing a plurality of substances. In various exemplary embodiments, each substance includes an ultraviolet photosensitive resin that cures upon exposure to a range of wavelengths of ultraviolet light specific to that substance. In various exemplary embodiments, the range of wavelengths for each substance is distinct from the ranges for the other substances. In various exemplary embodiments, where the plurality of substances are deposited on the substrate, partially curing the plurality of substances can include irradiating each of the plurality of substances with the range of wavelengths of ultraviolet light specific to that substance. In various exemplary embodiments, where the plurality of substances are deposited on the substrate, completing the curing of the plurality of substances can also include further irradiating each of the plurality of substances with the range of wavelengths of ultraviolet light specific to that substance.

In various exemplary embodiments, depositing a plurality of substances can include depositing a first substance, a second substance, a third substance and a fourth substance on the substrate. The first substance includes a first ultraviolet photosensitive resin that polymerizes upon exposure to a first range of wavelengths. The second substance includes a second ultraviolet photosensitive resin that polymerizes upon exposure to a second range of wavelengths. The third substance includes a third ultraviolet photosensitive resin that polymerizes upon exposure to a third range of wavelengths. The fourth substance includes a fourth ultraviolet photosensitive resin that polymerizes upon exposure to a fourth range of wavelengths.

Partially curing at least one substance of the first, second, third and fourth substances can include irradiating the first, second, third and fourth substances. The first substance can be irradiated with an amount of ultraviolet light having a wavelength within the first range of wavelengths, effective to achieve the first viscosity in the first substance. The second substance can be irradiated with an amount of ultraviolet light having a wavelength within the second range of wavelengths, effective to achieve the first viscosity in the second substance. The third substance can be irradiated with an amount of ultraviolet light having a wavelength within the third range of wavelengths, effective to achieve the first viscosity in the third substance. The fourth substance can be irradiated with an amount of ultraviolet light having a wavelength within the fourth range of wavelengths, effective to achieve the first viscosity in the fourth substance.

Completing the curing of the first, second, third and fourth substances can include further irradiating the first, second, third and fourth substances. The first substance will be further irradiated with an amount of ultraviolet light having a wavelength within the first range of wavelengths, effective to achieve the second viscosity in the first substance. The second substance will be further irradiated with an amount of ultraviolet light having a wavelength within the second range of wavelengths, effective to achieve the second viscosity in the second substance. The third substance will be further irradiated with an amount of ultraviolet light having a wavelength within the third range of wavelengths, effective to achieve the second viscosity in the third substance. The fourth substance will be further irradiated with an amount of ultraviolet light having a wavelength within the fourth range of wavelengths, effective to achieve the second viscosity in the fourth substance.

In various exemplary embodiments where four substances are deposited on the substrate, the first substance is cyan ink, the second substance is magenta ink, the third substance is yellow ink and the fourth substance is black ink. In other exemplary embodiments where four substances are deposited on the substrate, the first substance is red ink, the second substance is green ink, the third substance is blue ink and the fourth substance is black ink.

The systems and methods according to this invention selectively cure inks or other colored substances that include ultraviolet photosensitive resins for different process colors, for example, in the cyan-magenta-yellow-black system, or the red-green-blue-black system used when printing on transparent materials. Curing substances containing such ultraviolet photosensitive resins, made with different photoinitiators, makes each ink color photosensitive to a different range of wavelengths of light. As such, a light system that emits light over a range of wavelengths allows selective curing of the different substances and provides a wide range of control for the individual process colors. In various exemplary embodiments of the systems and methods according to this invention, the process color including the ultraviolet photosensitive resin that reacts to the least energetic wavelengths of light will be processed first. In such embodiments, the process color including the ultraviolet photosensitive resin that reacts with the most energetic wavelength of light such a system is processed last.

In various exemplary embodiments, three, rather than four, substances can be deposited on the substrate. In some such embodiments, a reduced set of three of the four above-described substances can be employed. For example, cyan, magenta and yellow of the cyan-magenta-yellow-black system, or red, green and blue of the red-green-blue-black system, can be used alternatively and economically to achieve full color. In various other exemplary embodiments, more than four process colors can be used to expand the full color spectrum to achieve better color fidelity.

FIG. 1 illustrates a first exemplary embodiment of a substance curing system 100 and related substance curing method, according to this invention usable to cure a substance deposited or ejected on a substrate 110. The first substance curing system 100 includes an applicator 120 usable to deposit or eject at least one substance 130, that includes an ultraviolet photosensitive resin, onto the substrate 110, and an ultraviolet light emitting device subsystem 140, positioned relative to the substrate 110 and able to irradiate the at least one substance 130 that has been deposited on the substrate 110.

The ultraviolet light emitting device subsystem 140 can include any known or later developed light emitting device that is capable of emitting ultraviolet light. The ultraviolet light emitting device subsystem 140 can include one or more separate light emitting devices, at least one array of light emitting devices, any other appropriate known or later-developed light source, or any combination of one or more separate light emitting devices, light sources, and/or one or more arrays. The ultraviolet light emitting device subsystem 140 can also include any known or later-developed device or fixture associated with the one or more light emitting devices, light sources and/or arrays that provides power, or manipulates intensity, direction, wavelength, or any other parameters of the light emitted by the one or more light emitting devices, light sources and/or arrays.

In various exemplary embodiments of the substance curing system 100, the substrate 110 is paper. In these exemplary embodiments, the applicator 120 deposits at least one ink or other ejectable fluid that includes an ultraviolet photosensitive resin onto the paper substrate 110. The at least one ultraviolet light emitting device of the light emitting subsystem 140 can include a scanning laser or a scanning light emitting diode. The at least one light emitting device of the light emitting subsystem 140 can also include a polygon raster output scanner. Addtionally, the at least one ultraviolet light emitting device of the light emitting subsystem 140 can include a stationary flood laser or a stationary flood light emitting diode.

During operation of the substance curing system 100, the applicator 120 deposits the at least one substance 130 that includes an ultraviolet photosensitive resin onto the substrate 110. After the at least one substance 130 has been deposited on the substrate 110, the ultraviolet light emitting device subsystem 140 partially cures the at least one substance 130 by irradiating the at least one substance 130 with ultraviolet light. The ultraviolet light emitting device subsystem 140 partially cures the at least one substance 130 by irradiating the at least one substance with ultraviolet light having a wavelength within the range of wavelengths to which the constituent photosensitive resin reacts, with an amount of light effective to achieve a desired viscosity in the substance. Completing the curing of the at least one substance 130 includes employing any suitable method or apparatus, such as irradiation or heating, to achieve a second viscosity in the at least one substance 130, where the second viscosity is greater than the first viscosity.

Figure 2:
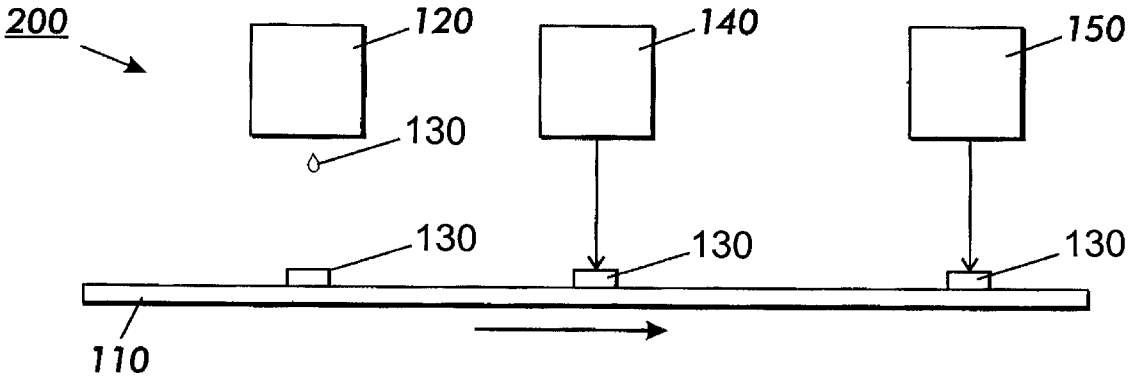
FIG. 2 is a schematic depiction of a second exemplary embodiment of the system according to the invention.

FIG. 2 illustrates a second exemplary embodiment of a substance curing system 200 and related substance curing method according to this invention. The second substance curing system 200 includes the elements 110–140 of the first substance curing system 100. Thus, these elements will not be described again. The second substance curing system 200 further includes a second ultraviolet light emitting device subsystem 150, positioned relative to the substrate 110. Like the ultraviolet light emitting device subsystem 140, the second ultraviolet light emitting device subsystem 150 includes one or more light emitting devices that are capable of irradiating the at least one substance 130 that has been deposited on the substrate 110. After the ultraviolet light emitting device subsystem 140 partially cures the at least one substance 130 that has been deposited on the substrate 110, the second ultraviolet light emitting device subsystem 150 further irradiates the at least one substance 130 with ultraviolet light to completely cure the substance. As shown in FIG. 2, in the second substance curing system 200, the second ultraviolet light emitting device subsystem 150 is spaced apart form the first ultraviolet light emitting device subsystem 140. Such spacing permits spatial or temporal delay between reactions of the first and second photoinitiators.

Figure 3:
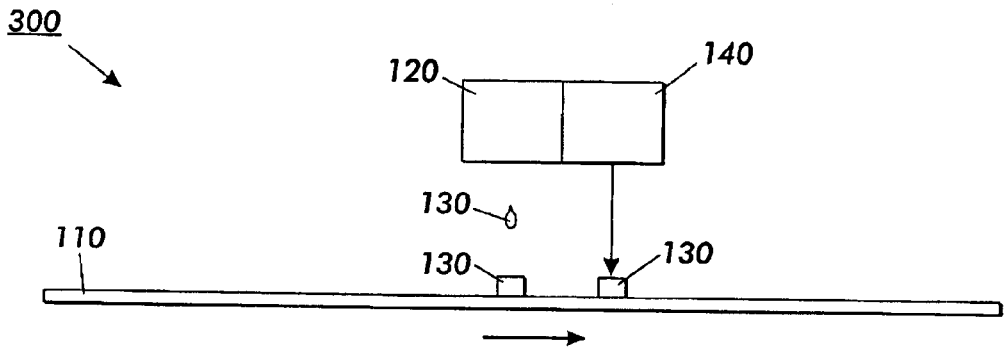
FIG. 3 is a schematic depiction of a third exemplary embodiment of the system according to the invention.

FIG. 3 illustrates a third exemplary embodiment of a substance curing system 300 according to this invention. The third substance curing system 300 includes the elements 110–140 of the first substance curing system 100. Thus, these elements will not be described again. In the third substance curing system 300, the ultraviolet light emitting device subsystem 140 is integrated with the applicator 120. During operation of the substance curing system 300, the applicator 120 deposits the at least one substance 130 that includes an ultraviolet photosensitive resin onto the substrate 110, in the same manner as the first substance curing system 100 of FIG. 1. After the at least one substance 130 has been deposited on the substrate 110, the ultraviolet light emitting device subsystem 140 partially cures the at least one substance 130 by irradiating the at least one substance 130 with ultraviolet light. However in the substance curing system 300, the ultraviolet light emitting device subsystem 140 is physically attached to, or formed to be a single module with, the applicator 120. In various exemplary embodiments, the applicator 120 and the ultraviolet light emitting device subsystem 140 can both be mounted on a moving carriage.

Figure 4:
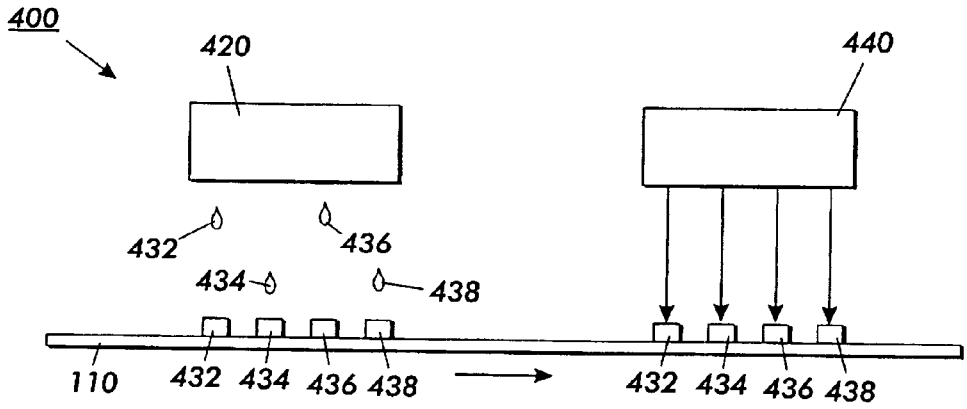
FIG. 4 is a schematic depiction of a fourth exemplary embodiment of the system according to the invention.

FIG. 4 illustrates a fourth exemplary embodiment of a substance curing system 400 and related substance curing method according to this invention. The various elements of the fourth substance curing system 400 are generally similar to the corresponding elements of the first, second and third substance curing systems 100–300. However, in contrast to the first, second and third substance curing systems 100–300, in the fourth substance curing system 400, the applicator 120 is replaced with an applicator 420. The applicator 420 is capable of separately depositing a plurality of substances 432, 434, 436 and 438 onto the substrate 110. Each of the plurality of separately deposited substances includes an ultraviolet photosensitive resin that cures upon exposure to a range of wavelengths of ultraviolet light specific to that substance and distinct from that of the other substances.

In various exemplary embodiments of the fourth substance curing system 400, the ultraviolet light emitting device subsystem 440 is capable of separately irradiating each of the plurality of substances 432, 434, 436 and 438 with light having a wavelength that is in the range of wavelengths of ultraviolet light specific to that substance.

In operation of the substance curing system 400, the applicator 420 deposits a plurality of substances on the substrate 110. The plurality of substances 432, 434, 436 and 438 can include, for example, a first substance, a second substance, a third substance and a fourth substance on the substrate 110. After the plurality of substances 432, 434, 436 and 438 have been deposited on the substrate 110, the ultraviolet light emitting device subsystem 440 partially cures the plurality of substances 432, 434, 436 and 438 by irradiating the plurality of substances 432, 434, 436 and 438 with ultraviolet light. The ultraviolet light emitting device subsystem 440 partially cures the plurality of substances 432, 434, 436 and 438 by separately irradiating each of the plurality of substances 432, 434, 436 and 438 with ultraviolet light having a wavelength within the range of wavelengths to which the constituent photosensitive resin reacts and with an amount of light effective to achieve a desired viscosity in the substance.

In the substance curing systems of this invention, the at least one light emitting device can include at least one array of light emitting devices. The at least one ultraviolet light emitting device can include a scanning laser or a scanning light emitting diode. The at least one ultraviolet light emitting device can be integrated with the applicator, as illustrated in FIG. 3. The first at least one light emitting device can include a polygon raster output scanner. The at least one ultraviolet light emitting device can also include a filtered ultraviolet lamp, a stationary flood laser or a stationary flood light emitting diode.

Figure 5:
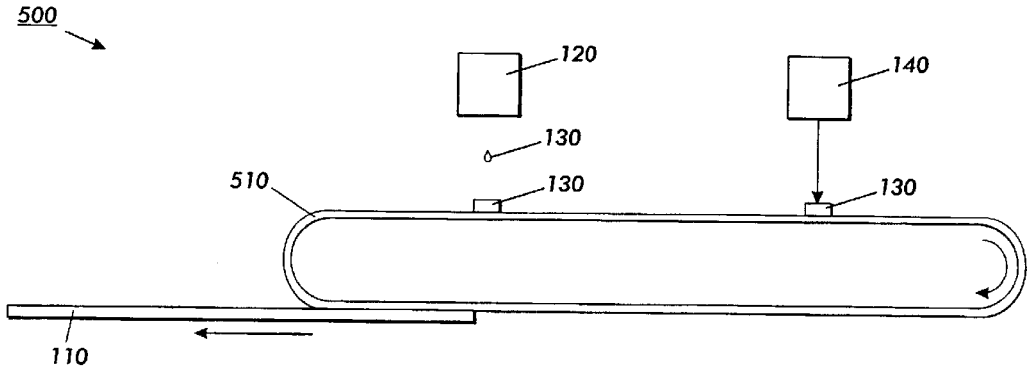
FIG. 5 is a schematic depiction of a fifth exemplary embodiment of the system according to the invention.

FIG. 5 illustrates a fifth exemplary embodiment of a substance curing system 500 and related substance curing method according to this invention. The fifth substance curing system 500 includes an intermediate substrate 510, the applicator 120 that is usable to deposit the at least one substance 130 onto the intermediate substrate 510, and the ultraviolet light emitting device subsystem 140, which is positioned relative to the intermediate substrate 510. The ultraviolet light emitting device subsystem 140 at least partially cures the at least one substance 130 deposited or ejected onto the intermediate substrate 510. The intermediate substrate 510 is positioned relative to the substrate 110 so the at least partially cured at least one substance 130 can be transferred to the substrate 110.

In various exemplary embodiments, the applicator 120 deposits the at least one substance 130 onto a smooth intermediate substrate 510. In various exemplary embodiments, the intermediate substrate 510 is an intermediate transfuse belt. Using an intermediate transfuse belt as the intermediate substrate 510 permits irradiation of the at least one substance 130 to raise the viscosity of the at least one substance 130 without hardening the at least one substance 130. The smooth surface of the intermediate substrate 510 permits formation of precise spots, which are not possible on other textured substrates, such as paper. The intermediate substrate 510 can have an anti-stick coating, such as Teflon, silicone oil on Viton, or other suitable coatings. An anti-stick coating facilitates transferring of the at least partially cured at least one substance 130 from the intermediate substrate 510 to the substrate 110. Spots or droplets of the at least one substance 130 are immobilized by irradiation, and then the partially cured at least one substance 130 is brought into contact with the substrate 110, which is, in various exemplary embodiments, paper or the like.

In various exemplary embodiments, particularly those used in color printing, the intermediate substrate 510 can be blackened. In embodiments where multiple are deposited on the intermediate substrate 514 and selectively cured, it is important that the ultraviolet light emitting device subsystem 140 be able to selectively irradiate each deposited at least one substance 130. When the ultraviolet light emitting device subsystem 140 emits light onto the at least one substance 130 on the intermediate substrate 514, light that is reflected by the intermediate substrate 514 can prematurely irradiate adjacent regions of the deposited at least one substance 130. A blackened intermediate substrate 514 prevents this pixel cross talk by absorbing, rather than reflecting, the emitted light. A blackened surface of the intermediate substrate 514 can be achieved by any suitable method, such as conventional black anodization, or conventional sputter coating with a material such as black chrome.

In operation of the fifth substance curing system 500, the applicator 120 deposits the at least one substance 130 onto the intermediate substrate 510. After the at least one substance 130 has been deposited on the intermediate substrate 510, the ultraviolet light emitting device subsystem 140 partially cures the at least one substance 130 by irradiating the at least one substance 130 with ultraviolet light. The ultraviolet light emitting device subsystem 140 partially cures the at least one substance 130 by irradiating the at least one substance with an amount of ultraviolet light having a wavelength within the range of wavelengths to which the constituent photosensitive resin reacts, with an amount of light effective to achieve a first desired viscosity in the substance. After the at least one substance 130 has been partially cured on the intermediate substrate 510, the at least one substance 130 is transferred from the intermediate substrate 510 to the substrate 110. Once the at least one substance 130 has been transferred to the substrate 110, the at least one substance 130 is completely cured by any suitable method or apparatus.

Figure 6:
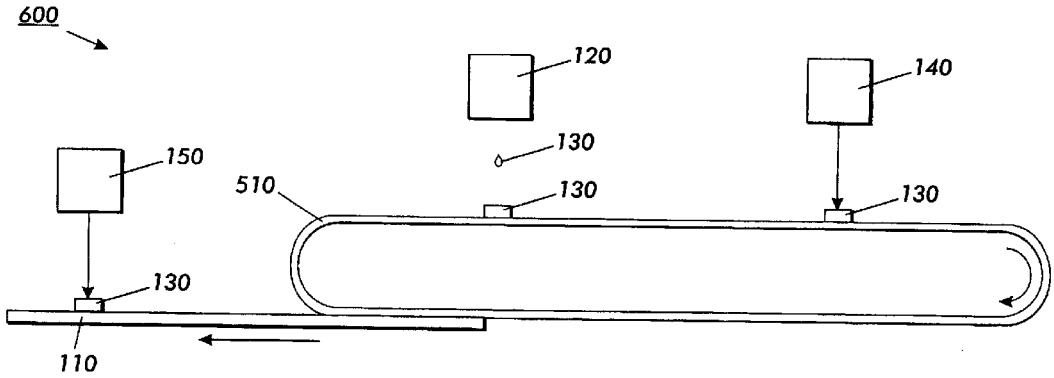
FIG. 6 is a schematic depiction of a sixth exemplary embodiment of the system according to the invention.

FIG. 6 illustrates a sixth exemplary embodiment of a substance curing system 600 and related substance curing method according to this invention. The sixth substance curing system 600 includes the second ultraviolet light emitting device subsystem 150, positioned to be usable to irradiate the partially cured at least one substance 130 after the partially cured at least one substance 130 has been transferred from the intermediate substrate 510 to the substrate 110. As with the fifth substance curing system 500 illustrated in FIG. 5, after the ultraviolet light emitting device subsystem 140 partially cures the at least one substance 130 that has been deposited on the intermediate substrate 510, the at least one substance 130 is transferred from the intermediate substrate 510 to the substrate 110. However, in the sixth substance curing system 600 illustrated by FIG. 6, the second ultraviolet light emitting device subsystem 150 further irradiates the at least one substance 130 with ultraviolet light after the at least one substance 130 has been transferred to the second substrate 110 to completely cure the substance 130.

Figure 7:
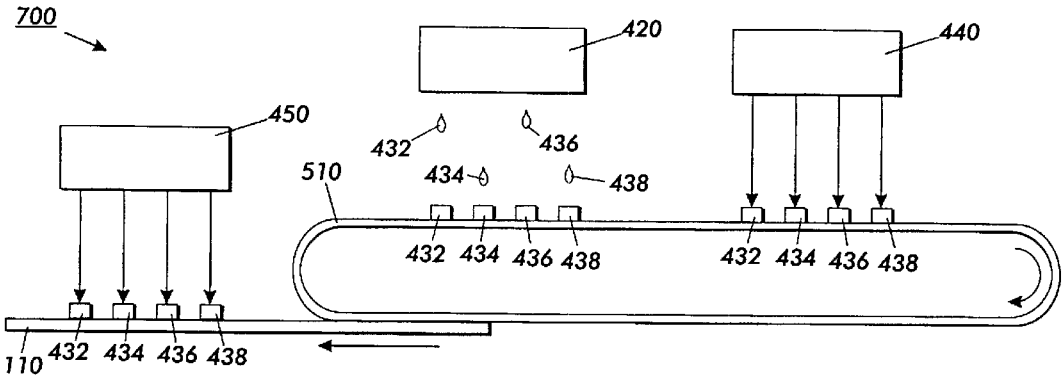
FIG. 7 is a schematic depiction of a seventh exemplary embodiment of the system according to the invention.

FIG. 7 illustrates a seventh exemplary embodiment of a substance curing system 700 and related substance curing method according to this invention. As shown in FIG. 7, in the seventh substance curing system 700, the applicator 120 and the light emitting device subsystem 140 of the sixth substance curing system 500 are replaced with the applicator 420 and the light emitting device subsystem 440 of the fourth substance curing system 400. The seventh substance curing system 700 further includes a second light emitting device subsystem 450, positioned to be usable to irradiate the plurality of substances 432, 434, 436, 438 that have been transferred to the intermediate substrate 510. The second light emitting device subsystem 450 can be implemented using any of the structures described with respect to the first light subsystem 430. Thus, further description of the second light subsystem 450 is omitted.

The applicator 420 is capable of separately depositing the plurality of substances 432, 434, 436 and 438. In this case, the applicator 420 deposits the plurality of substances 432, 434, 436 and 438 on the intermediate substrate 510 rather than the substrate 110.

In various exemplary embodiments, the substance curing system 700 includes the light emitting subsystem 440 that is capable of separately irradiating each of the plurality of substances 432, 434, 436 and 438 with the range of wavelengths of ultraviolet light specific to each substance. The substance curing system 700 also includes a second ultraviolet light emitting device subsystem 450, positioned to be usable to irradiate the partially cured plurality of substances 432, 434, 436 and 438 after the partially cured plurality of substances 130 have been transferred from the intermediate substrate 510 to the substrate 110.

In operation of the seventh substance curing system 700, the applicator 420 deposits a plurality of substances on the intermediate substrate 510. The plurality of substances 432, 434, 436 and 438 can include, for example, a first substance, a second substance, a third substance and a fourth substance. After the plurality of substances 432, 434, 436 and 438 has been deposited on the substrate 110, the ultraviolet light emitting device subsystem 440 partially cures the plurality of substances 432, 434, 436 and 438 by irradiating the plurality of substances 432, 434, 436 and 438 with ultraviolet light. After the plurality of substances 432, 434, 436 and 438 has been partially cured on the intermediate substrate 510, the plurality of substances 432, 434,436 and 438 is transferred from the intermediate substrate 510 to the substrate 110. Once the plurality of substances 432, 434, 436 and 438 has been transferred to the substrate 110, the plurality of substances 432, 434, 436 and 438 is completely cured by any suitable method or apparatus. In various exemplary embodiments including the embodiment illustrated by FIG. 7, the second ultraviolet light emitting device subsystem 450 further irradiates the plurality of substances 432, 434, 436 and 438, that have been transferred to the substrate 110, with ultraviolet light to completely cure the plurality of substances 432, 434, 436 and 438.

While this invention has been described in conjunction with the specific embodiments above, it is evident that many alternatives, combinations, modifications, and variations are apparent to those skilled in the art. Accordingly, the preferred embodiments of this invention, as set forth above are intended to be illustrative, and not limiting. Various changes can be made without departing from the spirit and scope of this invention.

What is claimed is:

1. A method for curing substances, comprising:

depositing at least one substance onto a substrate, the at least one substance comprising an ultraviolet photosensitive resin;

partially curing the at least one substance by irradiating the at least one substance using at least one ultraviolet light emitting device; and separately completing the curing of the at least one substance by further irradiating the at least one substance using the at least one ultraviolet light emitting device.

2. The method of claim 1, wherein depositing at least one substance comprises depositing at least one ink that includes an ultraviolet photosensitive resin.

3. The method of claim 1, wherein separately completing the curing comprises further irradiating the at least one substance using a second at least one ultraviolet light emitting device.

4. The method of claim 3, wherein the first and second at least one ultraviolet light emitting devices are spaced apart in a direction of movement of the substrate.

5. The method of claim 1, wherein partially curing the substance comprises partially curing the substance with an ultraviolet light emitting diode or an ultraviolet laser.

6. The method of claim 1, wherein depositing the at least one substance comprises depositing a plurality of substances, each of the plurality of substances including an ultraviolet photosensitive resin that cures upon exposure to a range of wavelengths of ultraviolet light specific to that substance.

7. The method of claim 6, wherein depositing a plurality of substances comprises depositing a plurality of substances, each of the plurality of substances including an ultraviolet photosensitive resin that cures upon exposure to a range of wavelengths of ultraviolet light different from that of the other substances.

8. The method of claim 6, wherein partially curing comprises irradiating each of the plurality of substances with the range of wavelengths of ultraviolet light specific to that substance.

9. The method of claim 7, wherein separately completing the curing comprises further irradiating each of the plurality of substances with the range of wavelengths of ultraviolet light specific to that substance.

10. A substance curing system, comprising:

a substrate;

an applicator that deposits at least one substance onto the substrate, the at least one substance comprising an ultraviolet photosensitive resin; and at least one ultraviolet light emitting device, positioned relative to the substrate, each at least one ultraviolet light emitting device able to irradiate portions of the at least one substance that have been deposited on the substrate to achieve partial curing of the at least one substance, and to separately achieve complete curing of the at least one substance.

11. The method of claim 1, wherein completely curing the substance comprises completely curing the substance with an ultraviolet light emitting diode or an ultraviolet laser.

12. The substance curing system of claim 11, wherein the applicator is usable to deposit at least one ink that include an ultraviolet photosensitive resin onto the substrate.

13. The substance curing system of claim 11, wherein the at least one ultraviolet light emitting device is at least one array of ultraviolet light emitting devices.

14. The substance curing system of claim 11, wherein the at least one ultraviolet light emitting device comprises at least one scanning laser or scanning light emitting diode.

15. The substance curing system of claim 11, wherein the at least one ultraviolet light emitting device comprises a polygon raster output scanner.

16. The substance curing system of claim 11, wherein the at least one ultraviolet light emitting device comprises a stationary flood laser or a stationary flood light emitting diode.

17. The substance curing system of claim 11, wherein the at least one ultraviolet light emitting device comprises a first set of at least one of the at least one ultraviolet light emitting device and a second set of at least one of the at least one ultraviolet light emitting device, each of the first and second sets usable to irradiate portions of the at least one substance that has been deposited on the substrate.

18. The substance curing system of claim 17, wherein the first and second sets are spaced apart in a direction of movement of the substrate.

19. The substance curing system of claim 11, wherein at least one of the at least one ultraviolet light emitting device is integrated with the applicator.

20. The substance curing system of claim 11, wherein the applicator is usable to separately deposit a plurality of substances on the substrate, each including an ultraviolet photosensitive resin that cures upon exposure to a range of wavelengths of ultraviolet light specific to that substance.

21. The substance curing system of claim 20, wherein each of the plurality of substances comprises an ultraviolet photosensitive resin that cures upon exposure to a range of wavelengths of ultraviolet light different from that of the other substances.

22. The substance curing system of claim 20, wherein the at least one ultraviolet light emitting device is usable to irradiate each of the plurality of substances with the range of wavelengths of ultraviolet light specific to each substance.

* * * * *